United States Patent [19]

Finkbeiner

[11] Patent Number: 4,798,266

[45] Date of Patent: Jan. 17, 1989

[54] HYDRAULIC HOIST PLATFORM

[76] Inventor: Gerhard Finkbeiner, Kasernenstrasse 6, 7290 Freudenstadt, Fed. Rep. of Germany

[21] Appl. No.: 17,766

[22] Filed: Feb. 20, 1987

[30] Foreign Application Priority Data

Feb. 21, 1986 [DE] Fed. Rep. of Germany ..... 3605650

[51] Int. Cl.[4] ..... B66F 7/08

[52] U.S. Cl. ..... 187/8.71; 187/18; 254/89 H

[58] Field of Search ..... 187/8.67, 8.72, 8.71, 187/8.74, 8.75, 18, 8.41, 8.59; 254/89 H, 10 R, 10 B, 10 C, 8 R, 8 B, 8 C

[56] References Cited

U.S. PATENT DOCUMENTS 2,201,147 5/1940 Bary et al. ..... 187/8.72
4,555,089 11/1985 Eck ..... 254/10 B

FOREIGN PATENT DOCUMENTS 1958604 6/1970 Fed. Rep. of Germany ..... 254/8 B
1218369 5/1960 France ..... 187/18
6413413 1/1965 Netherlands ..... 187/8.75
2053152 2/1981 United Kingdom ..... 187/8.59

*Primary Examiner*—Joseph J. Rolla
*Assistant Examiner*—Nils E. Pedersen

[57] ABSTRACT

A hydraulic hoist platform for passenger vehicles has floor group halves spaced from one another and a parallelogram device for each floor group half, movable up and down parallel to one another in a vertical plane and each comprising a carrier arm and a guide rod having a first end region articulated to its respective floor group half with bearing bodies highly loadable at least by torsion. The parallelogram devices have a second end region having a support device for the passenger vehicle. A lever device is secured rigidly to the outer region of each of the bearing bodies, and is angularly offset from the carrier arm in the direction of lifting. A hydraulic unit is arranged substantially horizontally in each of the floor groups, and is connected between the lever device and the floor groups.

16 Claims, 1 Drawing Sheet

HYDRAULIC HOIST PLATFORM

This invention relates to a hoist platform for vehicles, and more specifically for vehicles in the size range of passenger motor vehicles, such as passenger cars, passenger car trailers and the like.

Such hydraulic platforms have a floor group that is stationery when in use and supports static and dynamic loads on a floor. The floor group comprises two floor group halves that are spaced from one another by a distance greater than the width of a passenger motor vehicle. A hydraulic unit is provided for each of the floor group halves, each of the hydraulic units having a hydraulic cylinder with a first horizontal bearing half and a piston rod with an end having a second horizontal bearing half that is parallel to the first horizontal bearing half.

A parallelogram device is provided for each of the floor group halves, each of the parallelogram devices being movable up and down parallel to one another in a vertical plane, each comprising a carrier arm and a guide rod having a first end region with first and second horizontal bearings at which the carrier arm and the guide rod are articulated to their respective floor group halves. The first horizontal bearing is spaced a smaller distance from the floor than said second horizontal bearing. The parallelogram devices have a second end region having a support device for the passenger vehicle.

Such a hoist platform serves to lift a vehicle so that it is possible to work on its under side. It must be possible for example to grease and to change the oil. It must be possible to work on the exhaust system. It must be possible to work in the lower region of the engine. It must be possible to work on the wheel suspensions. Even the door sills must be accessible. It must be possible to close and open the doors without hindrance by the hoist platform. Such a hoist platform must satisfy the safety conditions, since it is necessary to work under the load. Nevertheless the hoist platform must be sufficiently cheap to be affordable even for normal workshops. It is suitable for passenger cars, trailers and caravans. The weights of the loads to be lifted lie in the range between 500 kg and 4 tons.

These hoist platforms must not be confused with other hoist platforms which must have other principles of design.

By way of example, motor cycle hoist platforms are built according to different principles. Here the vehicle has to be lifted less high, and a single column behind the motor cycle is sufficient.

The hoist platform should also not be confused with hydraulic hoist platforms such as are characteristic of tirechanging works. Here the vehicle is lifted a few decimeters only so high that the wheels, hanging from their suspension, come free from the ground so that the tires and rims can be changed.

The hoist platforms which lift heavy vehicles such as omnibuses and freight trucks for example are also to be designed according to different principles.

The hoist platforms according to the invention in their end position lift a vehicle to about 1.9 meters, so that a man of normal height standing under the vehicle can work with head clearance.

With regard to the MHB 2000 hoist platform, the following is valid: (a) On account of the necessary articulated attachment of the hydraulic units and the parallelogram geometry the carrier arms can be brought only to about 60 degrees elevation. Therefore, the carrier arms—and thus also the guide arms—must be relatively long in order to gain head clearance for the fitters. Thus material is consumed. (b) If the carrier arms are long, then the moments to be taken up by them are also great. Therefore, they must be designed with a high resistance moment, which signifies weight, additional mechanical measures and money. (c) If the carrier arms are long, then the floor beams must also be long if the hoist platform is for mobile use. Thus again the hoist platform becomes bulky. (d) On account of the parallelogram geometry and its maximum angle the engine region, which receives frequent attention, when the vehicle is lifted—if it has the engine at the front—lies over the region of a floor beam which connects the two floor groups with one another. Therefore, one can frequently stumble over this floor beam. (e) For the same reasons the front wheels lie almost directly above the hydraulic units, and this too makes work more difficult. (f) In order not to load the carrier arms with additional moments, the hydraulic units pass through apertures in the pertinent carrier arm. The aperture must be so large that in both the fully lowered and the fully raised condition the hydraulic unit does not collide anywhere with the aperture. These large apertures signify a weakening in a region which is in any case weakened by the bearings which must be present. All this can be compensated only by large material accumulations, signifying weight and clumsiness. (g) In the lowered condition the cylinders with their supply conduits stand approximately vertically upwards and thus form the highest region of the hoist platform. This is troublesome in transport and the exposed hydraulic supply leads can be damaged. (h) The hydraulic units must be relatively long, even if their bearings are provided relatively close to the second bearing. However, short hydraulic units are lighter, cheaper and for the same diameter their piston rods are more immune to buckling forces. (i) The loading of the second bearing is extraordinarily high, because the distance between it and the cylinder bearing must be short. However, the short bearing must take up high torques. (j) Since the piston rod would be troublesome, the guide rod, seen from above, absolutely must be provided outside the pertinent carrier arm. Thus space is needed widthwise and also the guide rod exerts a moment upon the carrier arm. (k) The hoist platform is very bulky and is despatched as a whole. This signifies that much freight volume is required. It is not possible for a trader to keep a relatively large number of hoist platforms in stock, because these occupy too much floor area. (l) When a vehicle is lifted in the lifted condition it must stand nearly level, and not obliquely. It is not possible to feed pressure to each hydraulic unit. So that synchronism of the two carrier arms is compelled, the differential-piston technique must be used, in which from the one piston that flows out which is forced into the other. With the known hoist platform it is impossible to compel synchronism mechanically. Since the lower bearing of the carrier arms lies comparatively high, stability suffers.

OBJECT AND STATEMENT OF THE INVENTION

It is the object of the invention to provide a hoist platform of the type as initially explained which has higher stability, the carrier arm of which can be pivoted higher and accordingly can be shorter for equal ground clearance, which nevertheless makes short hydraulic units suffice and permits such a spatial position of these hydraulic units that these do not require extra space and can be accommodated tidily.

In accordance with the invention this object is achieved by the following features:

The first horizontal bearing is a bearing of the carrier arm and the second horizontal bearing is a bearing of the guide rod.

The first horizontal bearing comprises a horizontal bearing body highly loadable at least by torsion, which is considerably longer than the width of the carrier arm.

Each of the floor group halves have side members in which the bearing body is mounted.

Each of the bearing bodies has an inner region and an outer region.

The carrier arms are secured rigidly to the inner region of said bearing body.

A lever device is secured rigidly to the outer region of said bearing body.

The lever device is offset in angle in the direction of lifting in relation to the direction of the carrier arm.

Each of the hydraulic units is arranged substantially horizontally in each of the floor groups.

One of the bearing halves of the hydraulic unit is provided on the lever device and the other of the bearing halves of the hydraulic unit is provided on the floor group.

Here these advantages are retained, irrespective of whether the hoist platform is made mobile or anchored in the floor, whether the synchronism of the carrier arms is compelled mechanically or by the differential piston technique. The hoist platform has now the feature that, in the case of front-engined vehicles, the engine, even with a floor beam between the floor group halves, lies considerably in front of the floor beam, so that there is no danger of stumbling. The supply conduits to the hydraulic units can be provided in a protected manner. The hoist platform is in various respects less bulky, uses less material, is consequently lighter and if only for this reason can be transported better.

Advantageously, the inventions includes the following additional features:

The bearing body has two bearing surfaces that lie in the side members of each floor group half on the far side of the first end region of the carrier arm and on the far side of the lever device.

Due to these features, there is an optimal distance of the two bearing surfaces from one another, so that these can well take up the forces deriving from the moments.

The bearing body comprises outer and inner concentric tubes in which the outer tube is a torsion sleeve to which both the lever device and the carrier arm are rigidly secured, and the inner tube forms a first bearing on the far side of the carrier arm and at least indirectly forms a second bearing on the far side of the lever device.

Due to these features, the object is achieved that the occuring torsion forces are merely taken up by the torsion sleeve, while then the inner tube has to take up only the other forces. Frequently the root region of the carrier arm and also the hoist device will be welded to the torsion sleeve (although other possibilities of fastening are also conceivable). Then heat occurs. If then the torsion sleeve is distorted a little, the bearing geometry nevertheless remains the same in the region of the bearing surfaces.

The inner tube has an end and the torsion sleeve has an outer end. A first cover closes the inner tube at its end. A second cover closes the torsion sleeve at its outer end. The covers have mutually facing surfaces formed as clutch halves. A clamping device draws the covers against one another.

By these features, a simply fitted connection is obtained between the inner tube and the torsion sleeve, which is favorable to the fitting of individual parts and also storage in a small space.

The first cover has a threaded hole. The second cover has a through hole. A headed screw has a shank which is screwed into the threaded hole in the first cover and passes through the through hole in the second cover. The head of the screw presses at least indirectly upon the second cover.

By these features, one can connect the two covers with one another in a simple manner and easily separate the connection again if fitting work becomes necessary, for example, prior to transport.

The clutch halves are Hirth-type toothings.

This feature is favorable since for example in contrast to a dog clutch the base of the teeth of a Hirth-type toothing is larger, and also the Hirth-type toothing is of shorter construction, so that accordingly the hoist platform does not have to be made wider than is absolutely necessary. A Hirth-type toothing transmits great torsion moments with small external diameter.

Each of the floor group halves has an outer side member with an inner surface and a bearing ring. The second cover terminates away from the inner surface of the outer side member. The second cover has an external cup-shaped depression. A disc is radially and immovably locked in the depression. A rotational bearing surface is arranged on the circumference of the disc and guided in the bearing ring of the side member.

Due to these features, the toothing can be laid inwards and the bearing surface on the far side of the lever device can be laid optimally far outwards, whereby the distances between the two bearing surfaces become of optimum size.

The rotational bearing surface has a diameter that is equal to the external diameter of the inner tube. A second similar bearing ring for the inner tube is provided on the inner side member.

Due to this feature, it is possible to use two like bearing rings, which simplifies the production and also equalizes the bearing conditions.

The bearing rings form axial movement stops for the torsion sleeve.

Due to this feature, one obtains a torsion sleeve of optimum width and at the same time automatically obtains those stops which limit the axial movement.

The inner tube is a synchronizing tube subject to torsion loading and extends between the floor group halves.

This feature is outstandingly suitable in the case of mobile, electro-hydraulic hoist platforms with low drive-over floor beam. Here synchronism is compelled by simply inspected means and is not dependent upon the differential-piston technique. Then no watching of synchronism is needed and there is no fear of synchronism being destroyed by heat, as is sometimes the case with the differential-piston technique. The synchronizing tube can both form a bearing surface lying on the far side of the root of the carrier arm and prevent the one parallelogram device from sagging too much if a defect occurs on or around it.

The one bearing half that acts on the lever device is provided on the piston rod end.

By this feature, the overall height of the floor group halves is reduced, for the piston rod is more remote from the circumference of the bearing body, on account of its smaller diameter, than is the cylinder of a conversely arranged hydraulic unit. Such hydraulic units may always comprise a piston and a non-telescopic piston rod.

When the parallelogram device is in a lowered condition, the angle between the geometrical longitudinal axis of the hydraulic unit and the lever device is 90 degrees, plus or minus 30%.

By this feature, the object is achieved that the hydraulic unit works with maximum moment precisely when the load of the vehicle actually has to be lifted. In hoist platform firstly the beams are brought under the vehicle. In lifting this signifies an absolute idle travel of the order of 5 cm. Not even on further lifting must the load of the vehicle be carried immediately for the vehicle firstly merely rises off the springs. Only when the wheels are hanging down must the full load of the motor vehicle be carried, from an elevation of the carrier arm of the order of 10 degrees. Around this range it is desirable for the hydraulic unit together with the lifting device to deliver the optimum moment, and here again, on account of the sine law, even at 10 degrees deviation differences only detectable by calculation are concerned.

The angle is 100 degrees plus or minus 20 degrees.

The values according to this feature are especially suitable for practical purposes if one adopts as basis the usual idle distance and the distance by which vehicles, considered statistically, are lifted off their springs.

In the case of mobile hoist platforms, the erection of the carrier arm is 80 degrees plus 10 degrees =90 degrees.

By this feature, one achieves adequate safety even for those vehicles the unequal weight distribution of which is even 3/5 to 2/5, even for the case where that beam which is upper forward on the parallelogram device is drawn out to the maximum and the rear one is fully pushed in.

A guard tube has at each of its ends a flange which is rigidly connected with respective floor group halves and the synchronizing tube lies in the guard tube.

These features are especially suitable for those hoist platforms which not only are mobile within the workshop but also are dispatched in individual component groups. It is possible to store the guard tube with the flanges on its two ends and it is even possible to use the flange to stiffen that part of the floor group half which is covered by the flange.

The floor group halves comprise box sections standing on edge which accommodate the hydraulic unit and the lever device.

Floor group halves according to this feature are very torsionally rigid and protect the entire interior, for example the bearings, the hydraulic units, conduits etc.

The guide rod is arranged above the carrier arm.

Space in width is saved by this feature. Since the guide rod is always narrower than the carrier arm, it does not need to protrude laterally even if it is not quite central in relation to the guide rod.

Seen from above, the carrier arm and the guide rod have central axes that are coincident.

Due to this feature, the guide rod exerts no forces upon the carrier arm which would twist it.

DETAILED DESCRIPTION

Figure 1:
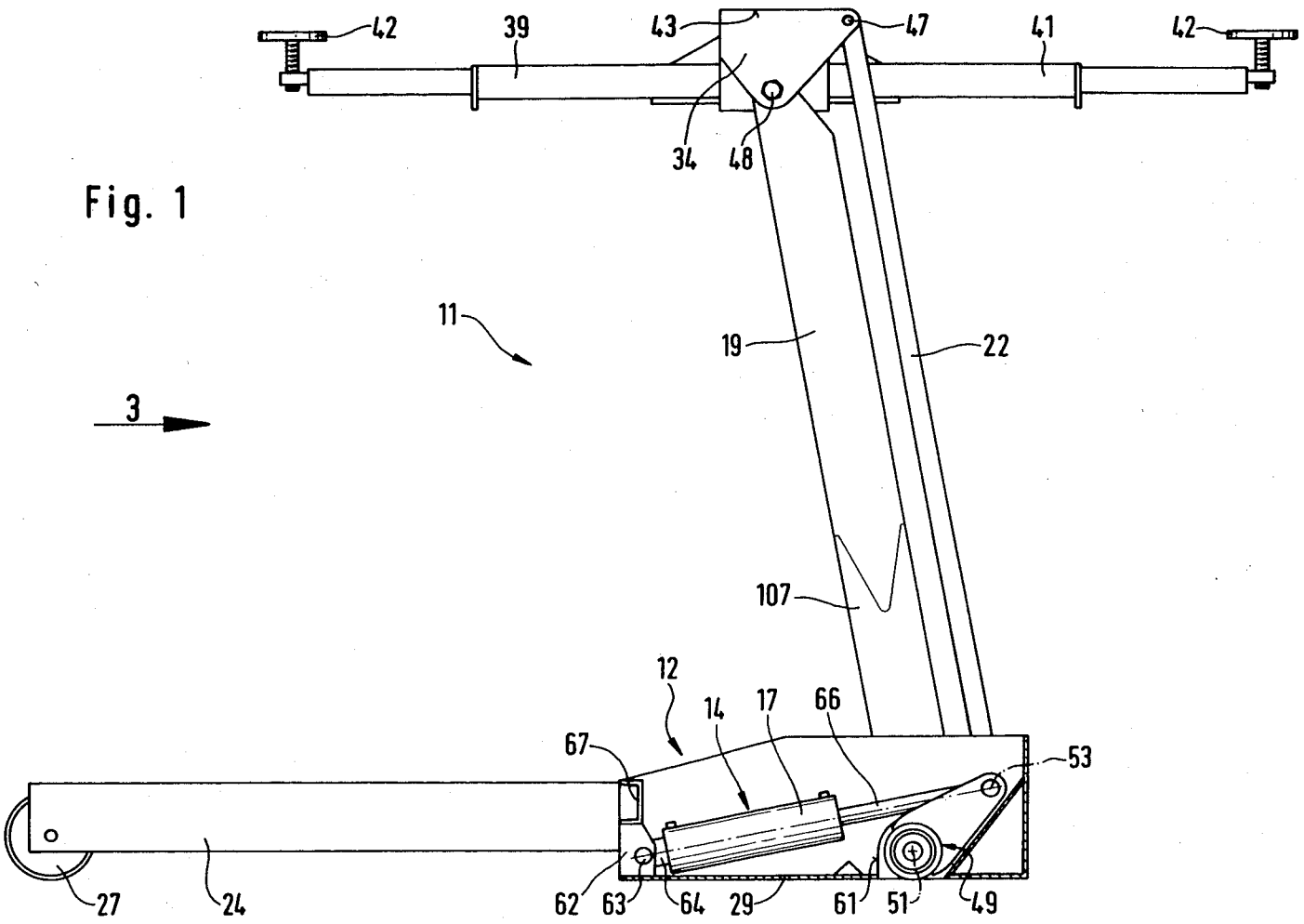
FIG. 1 shows the lateral elevation of the forward half of the hoist platform in its highest position, the outer wall of the floor group half being omitted.

A hydraulic hoist platform 11 is mobile in the direction of the arrow 3 in FIG. 1. According to Figuire 2 it has a left floor group half 12 and a right floor group half 13. In each of these a hydraulic unit 14, 16 is provided, each comprising a cylinder 17, 18. This is driven by an electric motor (not shown), which can be switched on and off and drives a hydraulic pump. To each side there pertains a carrier arm 19, 21 above which a guide rod 22, 23 is arranged. According to the view in FIG. 2 the carrier arms 19, 21 are just as wide as the guide rods 22, 23. According to the view in FIG. 1 the carrier arms are substantially wider than the guide rods. According to FIG. 2 the floor group halves 12, 13 merge into floor beams 24, 26 each carrying a wheel 27, 28 at its end, with which the floor beams 24, 26 stand on the floor. The floor group halves 12, 13 stand on the floor with large area with their floor plates 29. The floor group halves 12, 13 are connected detachably but rigidly with one another by a guard tube 31 and flanges 32, 33. The pivotable carrier beams 37, 38, 39, 41, which in the usual way are telescopic and carry support pads 42 of the usual configuration on their ends, are articulated in the usual way to the free ends of the carrier arms 19, 21 and of the guide rod 22, 23, through connection plates 34, 36 arranged on both sides. As may be seen especially from the view in FIG. 1, it is readily possible to place the upper edge 43 of the connection plate 34 and naturally also of the other connection plates so low that when the motor vehicle is lifted—even if it is a low-built vehicle—the doors can be opened. It is possible to refer to the illustration because all Figures are to scale.

If hereinafter only parts of the one or the other half of the hoist platform are described, let it be pointed out that the hoist platform is symmetrical about the vertical central plane 44.

Figure 2:
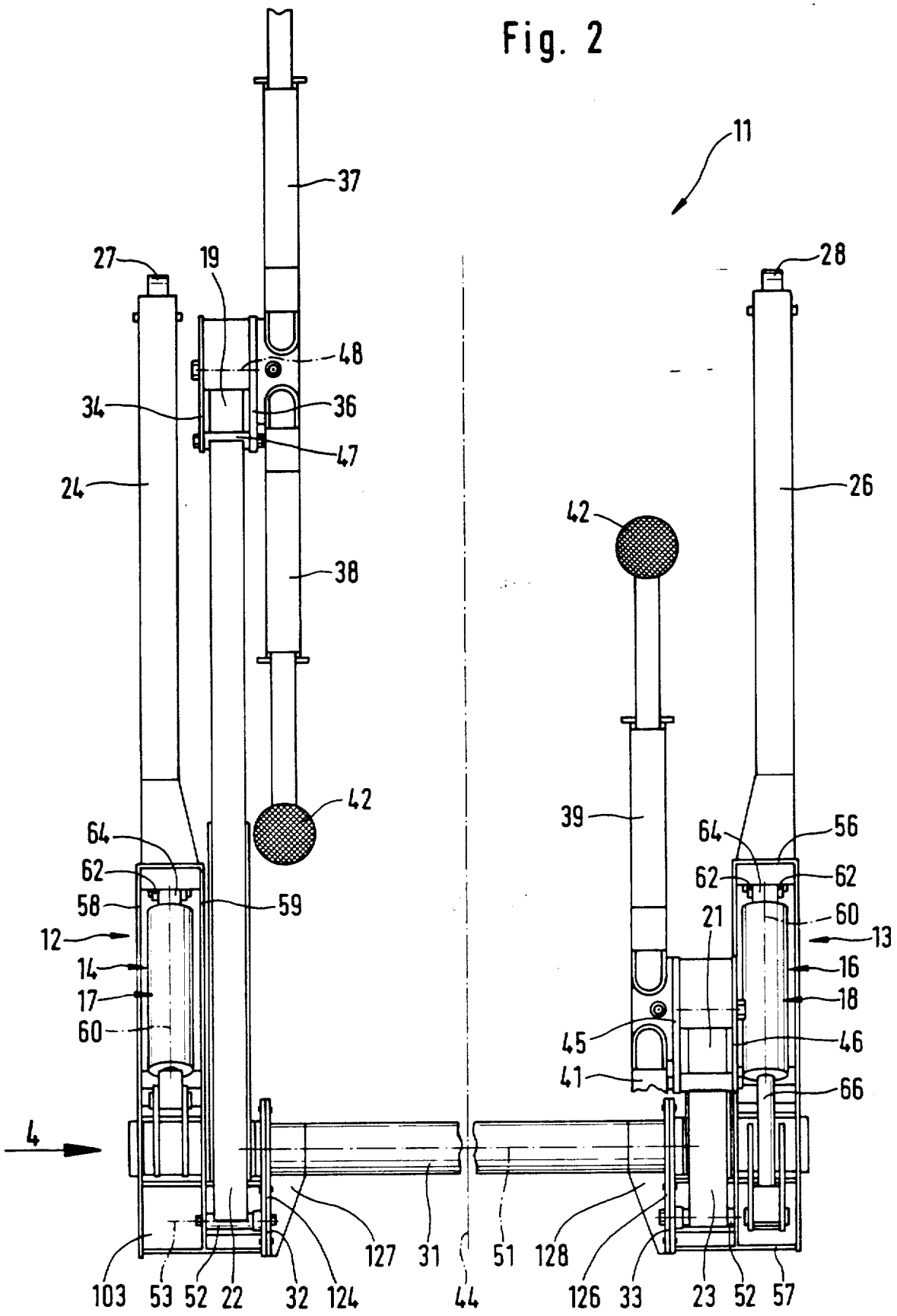
FIG. 2 shows the plan view of a hydraulic hoist platform with broken-away middle region, the left half thereof with its parallelogram device being completely lowered.
Figure 3:
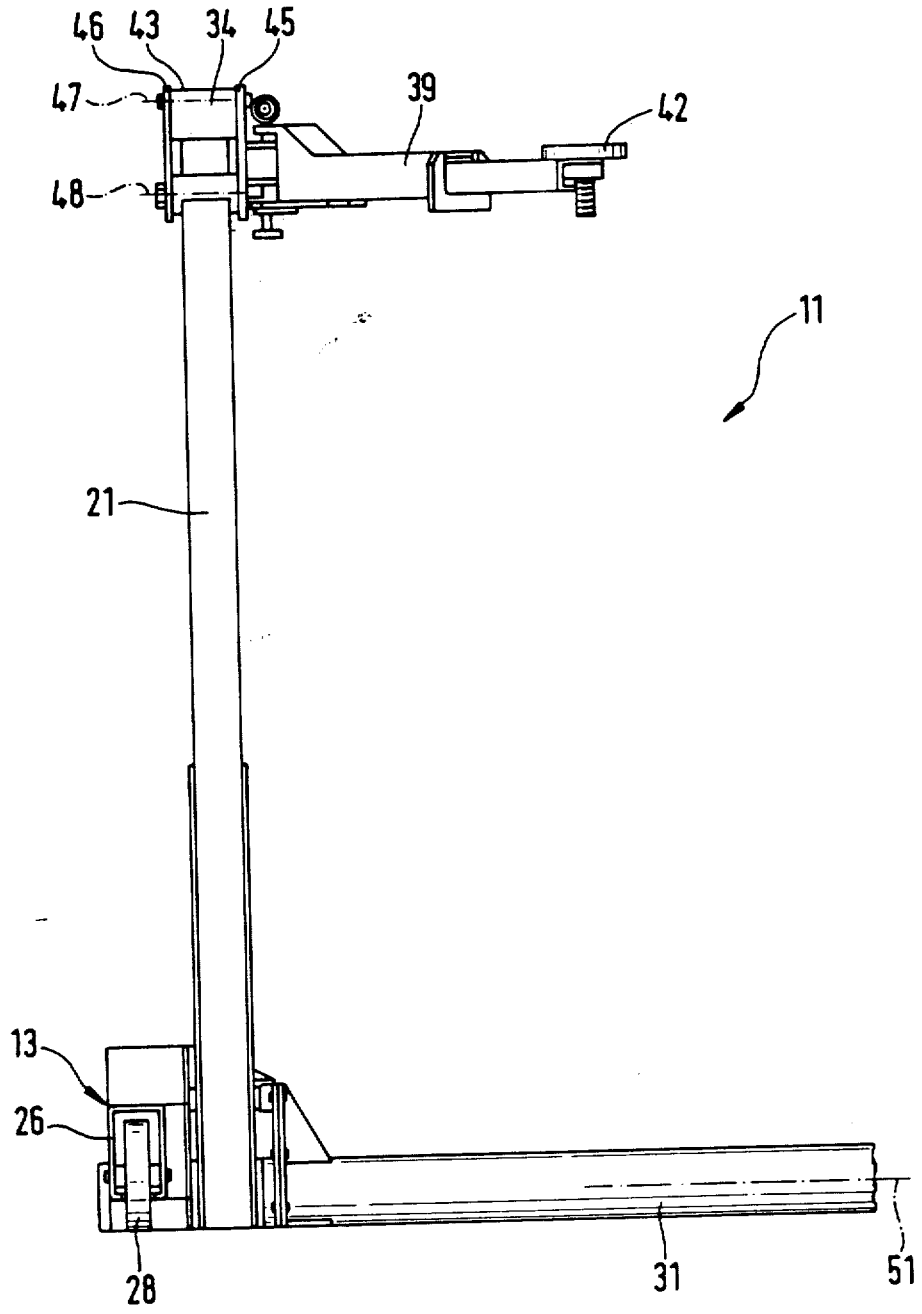
FIG. 3 shows a view in the direction of the arrow 3 in FIG. 1, but with guard tube flanged on, FIG. 4 shows a view in the direction of the arrow 4 in FIG. 2, on an enlarged scale, with the outer wall of the floor group half broken away.

The parallelogram device on the right in FIG. 2 is formed by the carrier arm 21, the guide rod 23, an inner connection plate 45 and an outer connection plate 46. The two are connected with one another by a horizontal upper bearing 47, a lower bearing 48 parallel thereto. The distance between the upper bearing 47 and the lower bearing 48 corresponds to the third parallelogram path.

The fourth parallelogram path is formed by a first, low bearing 49 (FIGS. 1, 5) which has a horizontal geometrical central axis 51 and to which the lower end region of the carrier arm 21 is articulated in a manner to be described later, and by a second bearing 52, which has a horizontal central axis 53 lying parallel to and higher than the geometrical central axis 51, and thus forms the fourth parallelogram side. According to FIG. 1 the geometrical central axis 53 lies to the upper right of the geometrical central axis 51. By reason of known geometrical conditions (length of the parallelogram sides, position of the angles) the support pads 52 always remain at the same level.

Each floor group half 12, 13 has the above-mentioned floor plate 29 which has below the geometrical central axis a transversely extending aperture 54 serving for assembly purposes. According to FIG. 5 on the left the floor plate 29 merges into a vertical wall 56 which reaches to the upper edge of the pertinent floor beam 24. On the right the floor plate 29 merges into a vertical wall 57 which reaches considerably above the geometrical central axis 53 and higher than the wall 56. Both the floor plate 29 and the walls 56, 57 are connected with one another by an outer vertical wall 58 and an aligned vertical wall 59, so that thus a very rigid box profile is produced. The walls 56, 57 begin, in the lateral elevation in FIG. 1, with the horizontal upper edge of the wall 56, rise gently to about shortly before half way and then extend completely horizontally to the likewise horizontal upper edge of the wall 57. The distance between the walls 58, 59 is such that there is still considerable clearance from the cylinder 17 in the elevation in FIG. 5. Above the aperture 54 only the wall 59 has an ascending arcuate aperture 61, which reaches to just above the first bearing 49. In the bottom left corner, according to FIG. 1, of the floor group there are situated to right and left of the geometrical central axis 60 of the hydraulic unit 14 two bearing lugs 62, through which a bolt 63 passes transversely which passes transversely through the bearing eye 64 provided on the left end of the cylinder 17. The bolt 63 is arranged so high that according to FIG. 4 the lower left edge of the cylinder 17 just no longer contacts the floor plate 29 when the piston rod 66 is extended. For further stiffening of the floor group and in order better to retain the bearings lugs 62 a U-section 67 open to the left is provided over these and is welded for the one part to the wall 56 and for the other to the walls 58, 59. The whole is then a welded and screwed construction which is rigid in itself. Not all welded seams and screw connections are shown in the drawing.

Figure 5:
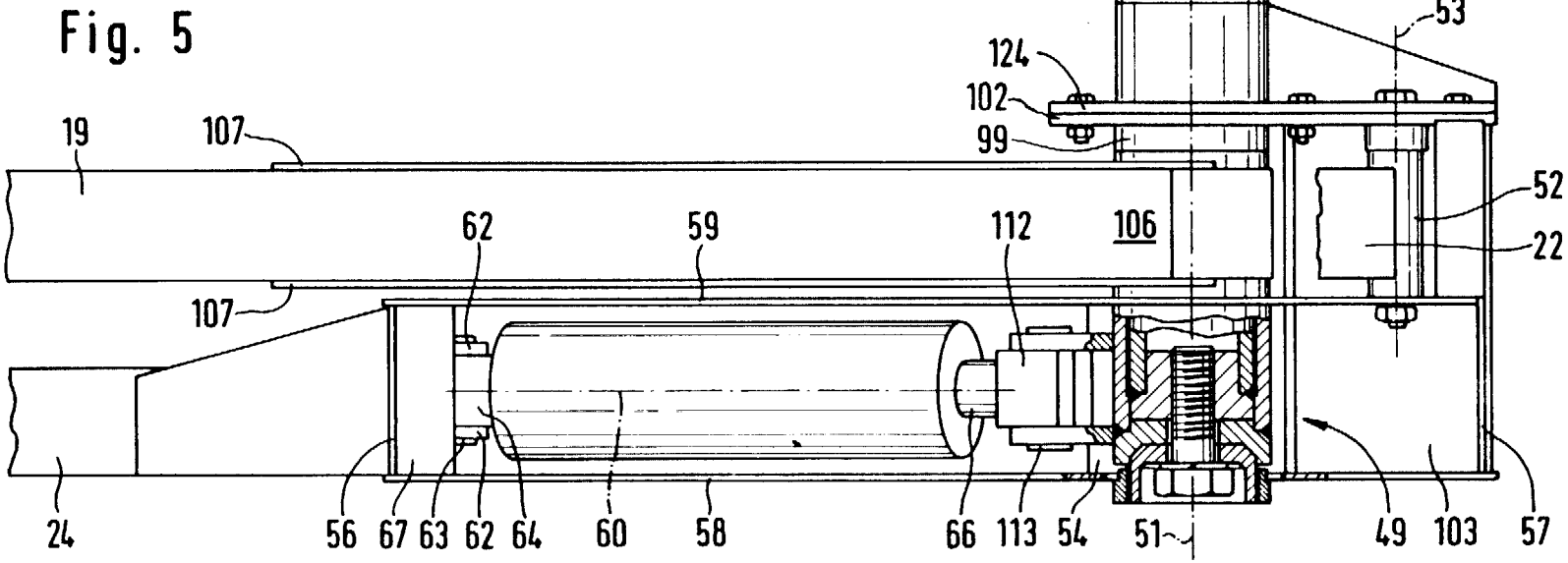
FIG. 5 shows a view in the direction of the arrow 5 in FIG. 4, FIGS. 1 to 5 showing a mobile, easily dismantlable hoist platform.

Now the region of the first bearing 49 will be explained by reference to FIG. 5*a*, which differs only in that a dog coupling, to be explained later, is provided therein, while the illustration according to FIG. 5 shows a Hirth-type toothing.

Figure 5A:
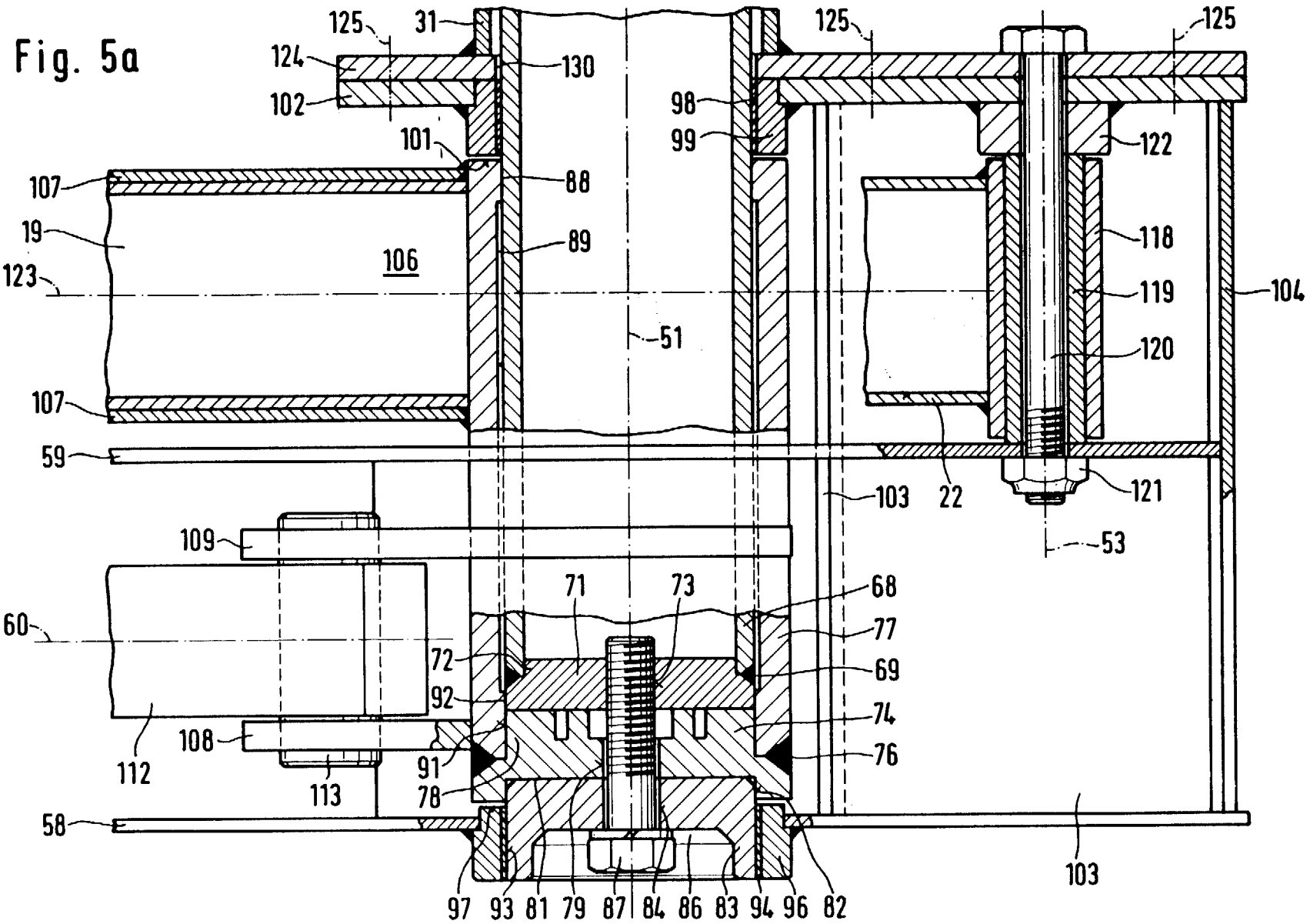
FIG. 5*a* shows an enlarged illustration from the right lower region of FIG. 5, but for a dog coupling.

In FIG. 5*a* there are seen the geometrical central axis 51 of the first bearing 49 and the geometrical central axis 53 for the second bearing. In the guide tube 31, which is coaxial with the geometrical central axis 51, there is situated a coaxial synchronising tube 68. This reaches a little beyond the line 65 of action of the hydraulic unit 14 and is welded at its end with a weld seam 69 to the circumference of a solid first cover 71, which extends with a centring projection 72 into the synchronising tube 68. The cover 71 has a coaxial threaded hole 73. On its face directed downwards in FIG. 5*a* there are provided four dog halves (not visible) which engage in matching apertures of a second cover 74. The latter is connected by a weld seam 76 with the lower end in FIG. 5*a* of a coaxial torsion sleeve 77, into which the second cover 74 reaches with its centring projection 78. The cover 74 has a coaxial through-passing hole 79 and a coaxial countersinking with radial flat bottom 81 and coaxial, circular-cylindrical edge 82 having a diameter equal to the external diameter of the synchronising tube 68. In this countersinking, thus guided, there is seated a bell 83 fitting in exactly there with the corresponding zones, which passes through the wall 58 and has a coaxial through-passing hole 84. In the countersinking 86 there is seated the head 87 of a screw the shank of which passes through the holes 79, 84 and the threading of which is screwed fast into the threaded hole 73. The torsion sleeve 77 is seated with a narrow inner annular zone 88, upwards in FIG. 5*a*, on the circumference of the synchronising tube 68. Because further outwards the torsion sleeve 77 is adjoiningly machined out by a few tenths of a millimetre, but the external circumference of the synchronising tube 8 continues circular-cylindrically coaxially, a non-carrying annular space 89 is formed there. At the lower end the torsion sleeve 77 again has its former circumference, so that there too a similar annular zone 91 is produced with which the torsion sleeve 77 lies both on the coaxial, circular-cylindrical external circumference 92 of the first cover 91 and also, bridging over the region of the dog coupling, on the coaxial, circular-cylindrical external circumference of the centring projection 78.

These measures contribute to easy assembly, dismantlement, production and positive association, and a region is generated which can be used for the multiple tasks to be discussed hereinafter. One of these tasks is fulfilled by the circular-cylindrical coaxial external circumference 93 of the bell 83, which forms one bearing half which runs on a PTFE lining 94 with which a bearing bush 96 is coated coaxially and circular-cylindrically, which bush passes through the wall 58 and is welded in there, protruding a little downwards. Thus one has a bearing corresponding to the geometrical central axis 53 for the synchronising tube 68 and the torsion sleeve 77. The annular inner face 97 of the bearing bush 96 is an axial stop for the opposite face of the second cover 74.

A second, similarly acting bearing of equal diameter is formed by a PTFE lining 98 similar to the lining 94, in which the external circumference of the synchronising tube 68 runs and which constitutes the coating for a bearing bush 99, the inner face 101 of which constitutes an axial stop for the upper end of the torsion sleeve 77 in FIG. 5*a*. The bearing bush 99 is welded into a coaxial aperture of a wall 102 which extends parallel to the wall 59 with some spacing, proceeds beyond the bearing bush 99 to the left and proceeds beyond the geometrical central axis 55 to the right. The connection of the wall 102 to the floor group half 12 takes place through a wall 103 extending obliquely upwards to the right according to FIG. 4. The wall 104 forms the continuation of the wall 57. The wall 103 extends from the wall 58 to the wall 102. Thus a rigid box is obtained.

Thus the wall 102 is connected rigidly against torsion with the floor group half 12. This design succeeds in providing the lining 98 at a considerable distance from the lining 94, which signifies a more secure mounting.

The root region 106 of the carrier arm 19 is welded on that external circumference of the torsion sleeve 77 which lies on the far side of the wall 59. The carrier arm 19 is a box section standing on edge, the two walls of which which are vertical in use are doubled by a stiffening plate 107 each. Two levers 108, 109 are welded symmetrically of the line 65 of action and centrally between the walls 58, 59 on the circumferential region there of the torsion sleeve 77, of which levers one end zone 111 of open-end spanner form grasps in fitting manner over the circumference of the torsion sleeve 77 by somewhat more than 180° (FIG. 4), so that the occurring forces can be introduced over a long circumferential zone. The levers 108, 109 taper according to FIG. 4 towards the joint head 112 of the piston rod 66 and there have a transverse hole through which a bolt 113 passes, so that an articulated connection is produced. According to FIG. 4 the angle 114 between the line 65 of action and the radial central plane 116 amounts to 100° when the carrier arm 19 is in its lowermost position. If now pressure is admitted through conduits (not shown) from a hydraulic pump (not shown) to the cylinder 17 (and at the same time to the cylinder 18 too), the piston rod 66 moves out and the central axis of the bolt 113 travels a distance 117 amounting to 80° of arc, by which the carrier arm 19 is raised, as also shown by the carrier arm 21 in FIG. 1. It is seen that even in the end position, which is shown in dot-and-dash lines on the right in FIG. 4, the piston rod 66 does not come into contact with the torsion sleeve 77. If in FIG. 4 one considers the two dot-and-dash lines 65 of action in the two positions it is seen that the pivoting movement about the bolt 63 amounts to only about 10°, which is very little and makes little demand upon the flexibility of the supply conduits. This small pivoting movement also permits of accommodating the hydraulic unit 14 in a small space, out of which it never moves. The occurring forces are overcome without problem by the coatings 94, 98 of large area, which lie relatively far apart and also cannot rust, because they are formed not as rolling body bearings but as synthetic plastics material plain bearings. Also only the torsion sleeve 77 takes up the torsion forces between the carrier arm 19 and the levers 108, 109, and all other components are free therefrom. In so far as the synchronising shaft 68 must take up torsion forces to compel synchronism, these are lower by orders of magnitude. Admittedly the synchronising tube 68 must be placed, with regard to the accident prevention regulations, so that that carrier arm the region of which has a defect is held up at least so far as permitted by the accident prevention regulations with regard to the oblique position of a motor vehicle to be hoisted. Such oblique positions can amount to around 10°.

The joint around the geometrical central axis 55 for the lower end region of the guide rod 22, which has to take up no bending forces, is designed with a coaxial bush 118 welded in there. In this bush there is seated a coaxial sleeve 119 and in the latter again a coaxial threaded bolt 120. Its threading passes through the wall 59 and a nut 121 is screwed on to the protruding part. Thus the wall 59 serves as the one axial stop for the bush 118. The other axial stop is formed by an eye 122 which is internally screwed coaxially on to the wall 102. The central plane 123 pertaining to the carrier arm 19, in the plane of the drawing in FIG. 5*a*, is also at the same time the central plane of the guide rod 22, so that no lateral forces occur.

On each of the ends of the guard tube 31 there is provided a flat flange 124, 126 standing perpendicularly of the plane of the drawing in FIG. 2, which flange is additionally stiffened and supported through horizontal connection plates 127, 128. The flanges 124, 126 correspond in outline to the wall 102 and fit with large area on the latter. In part the connection of the flanges 124 is effected by the already mentioned respective threaded bolts 120, as shown especially distinctly by FIG. 5*a*. In addition a relatively large number of screw connections is provided which are symbolised by dot-and-dash lines 125 in FIG. 5*a*, so that the one floor group half is connected with the other floor group half rigidly in operation but dismantlably. A circular hole 130 is provided in the flange 124—and naturally also in the flange 126 on account of the mirror-image symmetry—coaxially with the geometrical central axis 53 for the passage of the synchronising tube 68.

Figure 4:
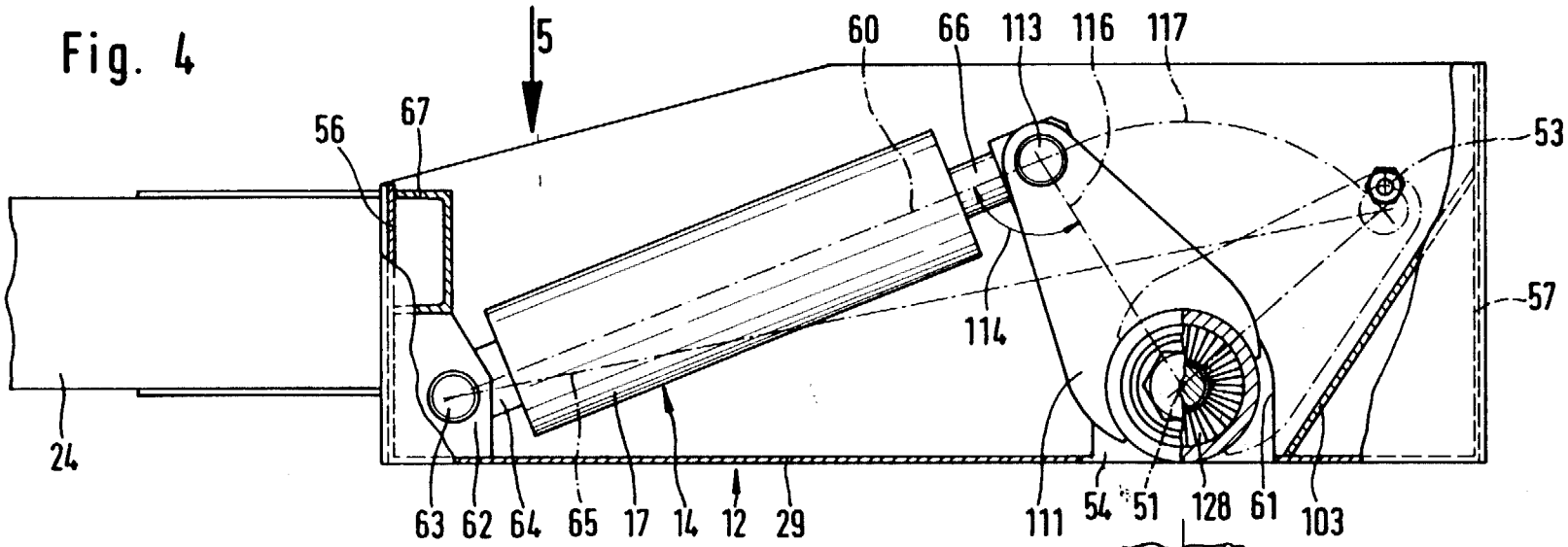

The difference between FIGS. 4, 5 for the one part and FIG. 5*a* for the other part is that FIGS. 4 and 5 show a Hirth-type toothing 128 in place of the above-mentioned dog coupling.

Assembly is simple: the torsion sleeve 77 is put into a position coaxial with the central axis 51 and then the synchronising tube 68 is pushed in from above according to FIG. 5*a* until the first cover 71 abuts on the second cover 74. Then the bell 83 is inserted and the screw 87 is screwed in. If the guard tube 31 has been screwed to the floor group half 12, then that region of the synchronising tube 68 appears above the flange 126. Now in the floor group half 13 too its torsion sleeve is brought into a position coaxial with the geometrical central axis 51 and then according to FIG. 2 the floor group half 13 is pushed thereto until there again its first cover abuts on the second cover. The bell in mirror image to the bell 83 is screwed in, the mirror-image screw is screwed in and then the flange 126 is screwed fast on the second floor group half 13.

Although the guard tube 31 extends only about 14 cm. above the floor and can be driven over readily, if the usual access ramps of embossed sheet metal are provided on both sides, here it is a matter of a floor beam which is unavoidable in transportable hoist platforms, unless the differential-piston technique is to be used.

Figure 6:
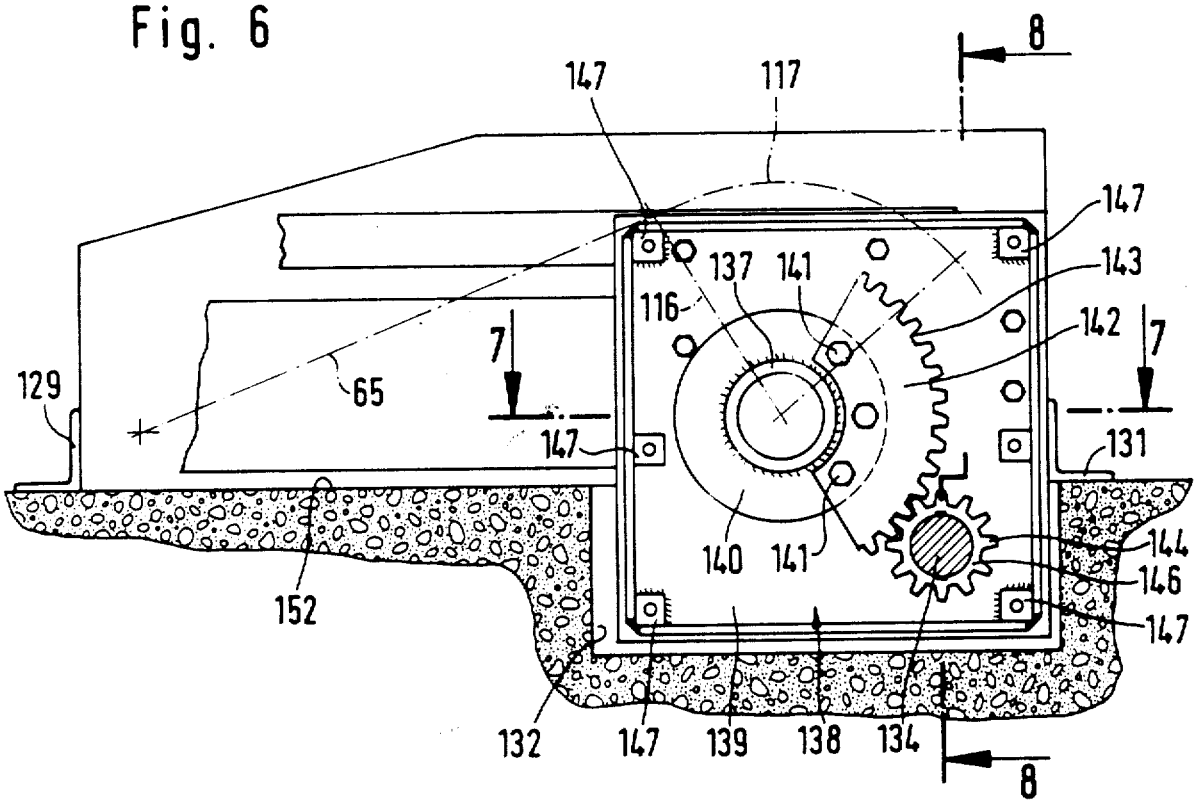
FIG. 6 shows a view similar to FIG. 4 of a second example of embodiment, but for fixed installation in a workshop floor or the like, FIG. 7 shows a section along the line 7—7 in FIG. 6.
Figure 7:
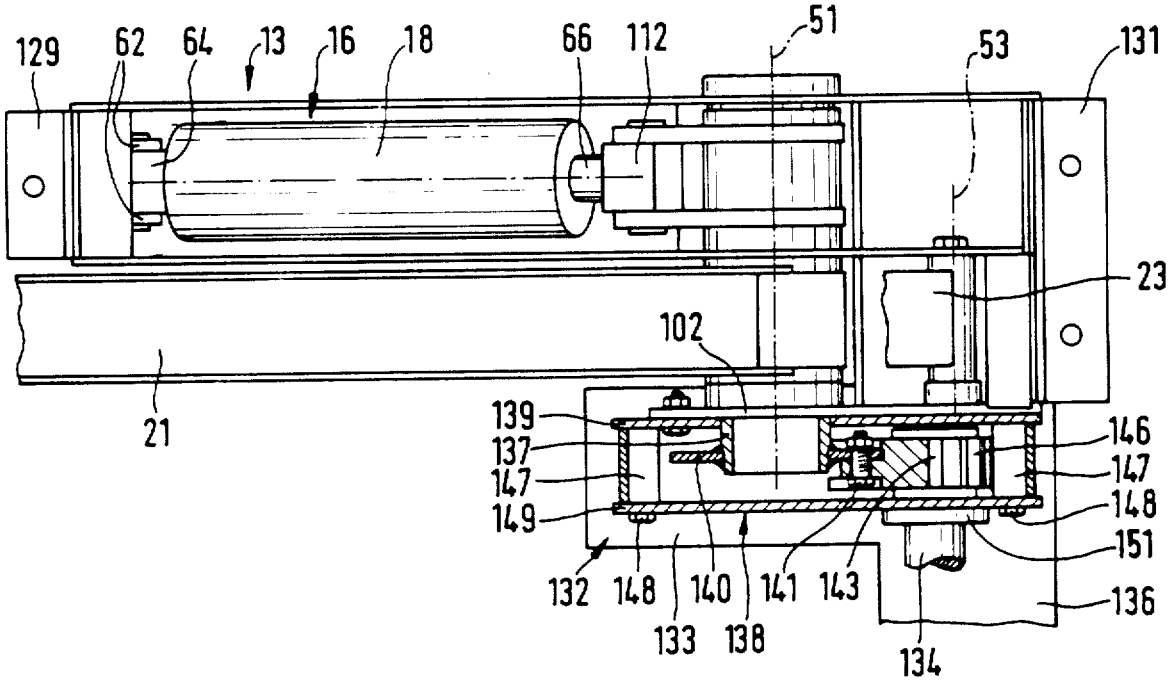

If however the hoist platform is for stationary use, the floor beams 24, 26 are not needed and according to FIGS. 6 and 7 the floor group halves can be screwed fast to the floor by L-angle pieces 129, 131. Then a shallow pit 132 will be provided in the floor, which has a widening 133 in the longitudinal direction close to the floor group halves and is only a narrow, easily covered channel 136 in the region of a solid synchronising shaft 134. The guard tube 31 with the flanges 124, 126 is eliminated. However the former synchronising tube 68 is drawn with a stub 137 into a gear box 138 of which the upper wall 139 in FIG. 7 is screwed against the wall 102. An annular disc 140 is welded radially on to the end zone of the stub 127. A sector 142 having teeth 143 on its external circumference is screwed from the front in FIG. 6 with screws 141 to this disc 140. This sector extends over about 120° and has a position, when the carrier arm 21 is lowered, in which it begins at about 4:30 o'clock and ceases at about 1:30 o'clock.

Figure 8:
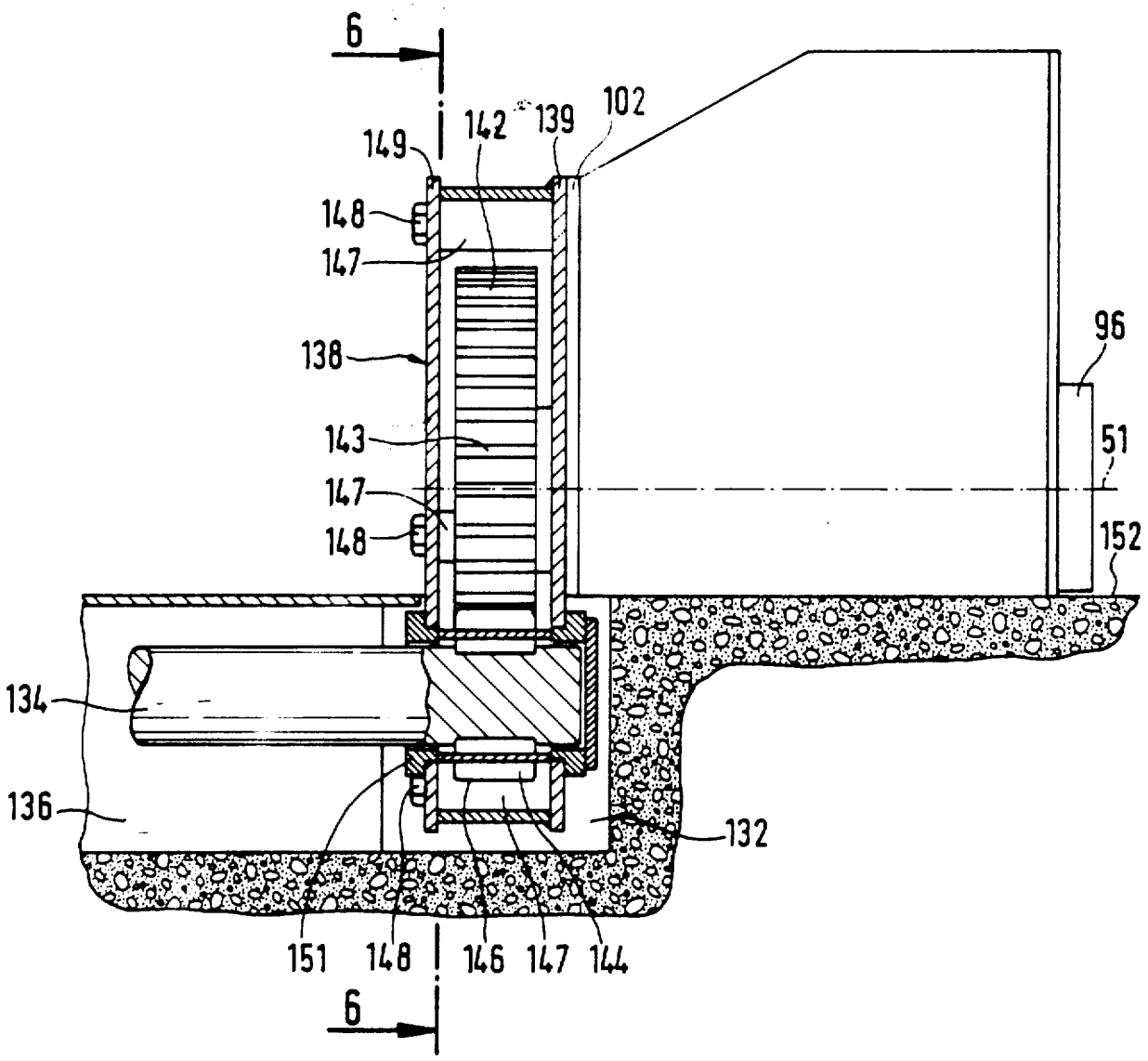
FIG. 8 shows a section along the line 8—8 in FIG. 6 with simultaneous indication of the section plane 6—6 for FIG. 6.

The teeth 143 mesh with teeth 144 of a pinion 146 which is seated rigidly on that end region of the synchronising shaft 143 which extends into the gear box 138. The wall 139 carries distance pieces 147 welded on it and protruding perpendicularly from it, which carry at the end a threaded hole into which screws 148 are screwed, six of which carry the wall 149 shown in FIG. 7 coinciding with the wall 139, which wall 149 is likewise a part of the gear box 138. The synchronising shaft 134 and thus also the pinion 146 are mounted in a bearing 151 coaxial with the synchronising shaft 134 and a further bearing (illustrated on the right in FIG. 8). In the case of this stationary solution it is a matter practically only of a synchronising shaft arranged not coaxially with the geometrical central axis 51. Rather this is laid as synchronising shaft 143 lower than the upper side 152 of the floor and the transmission necessary for this is provided.

The hoist platform can also serve for the hoisting of the upper vehicle in a double garage. In this case the carrier beams 37, 38, 39, 41 are replaced by a rising ramp. In order to achieve the necessary variations of angle of inclination for this ramp, then the carrier arms 19, 21 and/or the guide rod 22, 23 are made shorter.

What is claimed is:

1. Hydraulic hoist platform for vehicles in the size range of passenger motor vehicles, such as passenger cars, passenger car trailers and the like, comprising:

a floor group that is stationary when in use and supports static and dynamic loads on a floor, said floor group comprising two floor group halves that are spaced from one another by a distance greater than the width of a passenger motor vehicle, each of said floor group halves have two spaced-apart side members, a parallelogram device for each of said floor group halves, each of said parallelogram devices being movable up and down parallel to one another in a vertical plane, each comprosing a carrier arm and a guide rod having a first end region with first and second horizontal bearings at which said carrier arm and said guide rod are articulated to their respective floor group halves, said first horizontal bearing being spaced a smaller distance from the floor than said second horizontal bearing, said parallelogram devices having a second end region having a support device for the passenger vehicle, said first horizontal bearing is a bearing of said carrier arm and said second horizontal bearing is a bearing of said guide rod, each of said first horizontal bearings comprises a horizontal bearing body highly loadable at least by torsion, which has two rotational bearing surfaces spaced from one another in axial direction and rotatably supported by said spaced apart side members each of the respective floor group halves, each of said bearing bodies have an inner region and an outer region between its bearing surfaces, each of said carrier arms is secured rigidly to said inner region of the respective bearing body, a lever device is secured rigidly to said outer region of each of said bearing bodies, said lever device is angularly offset from said carrier arm in the direction of lifting in relation to the direction of said carrier arm, a hydraulic unit for each of said floor group halves, each of said hydraulic units having a hydraulic cylinder having a first horizontal bearing half and a piston rod having an end having a second horizontal bearing half that is parallel to said first horizontal bearing half, each of said hydraulic units is arranged substantially horizontally in each of said floor groups, and one of said bearing halves of said hydraulic unit is provided on said lever device and the other of said bearing halves of said hydraulic unit is provided on said floor group.

2. Hydraulic hoist platform according to claim 1, wherein said one bearing half that acts on said lever device is provided on said piston rod end.

3. Hydraulic hoist platform according to claim 1, wherein when said parallelogram device is in a lowered condition, the angle between the geometrical longitudinal axis of said hydraulic unit and said lever device is 100 degrees.

4. Hydraulic hoist platform according to claim 1, wherein said floor group halves comprise box sections standing on edge which accommodate said hydraulic unit and said lever device.

5. Hydraulic hoist platform according to claim 1, wherein said guide rod is arranged above said carrier arm.

6. Hydraulic hoist platform according to claim 5, wherein, seen from above, said carrier arm and said guide rod have central axes that are coincident.

7. Hydraulic hoist platform according to claim 1, wherein said bearing body comprises outer and inner concentric tubes in which said outer tube is a torsion sleeve to which both said lever device and said carrier arm are rigidly secured and said inner tube forms a first bearing on the far side of said carrier arm and at least indirectly forms a second bearing on the far side of said lever device.

8. Hydraulic hoist platform for vehicles in the size range of passenger motor vehicles, such as passenger cars, passenger car trailers and the like, comprising:

a floor group that is stationary when in use and supports static and dynamic loads on a floor, said floor group comprising two floor group halves that are spaced from one another by a distance greater than the width of a passenger motor vehicle, a hydraulic unit for each of said floor group halves, each of said hydraulic units having a hydraulic cylinder having a first horizontal bearing half and a piston rod having an end having a second horizontal bearing half that is parallel to said first horizontal bearing half, a parallelogram device for each of said floor group halves, each of said parallelogram devices being movable up and down parallel to one another in a vertical plane, each comprising a carrier arm and a guide rod having a first end region with first and second horizontal bearings at which said carrier arm and said guide rod are articulated to their respective floor group halves, said first horizontal bearing being spaced a smaller distance from the floor than said second horizontal bearing, said parallelogram devices having a second end region having a support device for the passenger vehicle, said first horizontal bearing is a bearing of said carrier arm and said second horizontal bearing is a bearing of said guide rod, said first horizontal bearing comprises a horizontal bearing body highly loadable at least by torsion, which is considerably longer than the width of said carrier arm, said first end region of said carrier arm and said lever device each have far sides with respect to each other, said bearing body has two bearing surfaces that lie in said side members of each floor group half on said far side of said first end region of said carrier arm and on said far side of said lever device, said bearing body comprises outer and inner concentric tubes in which said outer tube is a torsion sleeve to which both said lever device and said carrier arm are rigidly secured and said inner tube forms a first bearing on said far side of said first end region of said carrier arm and at least indirectly forms a second bearing on said far side of said lever device.

each of said floor group halves have side members in which said bearing body is mounted, each of said bearing bodies has an inner region and an outer region, said carrier arms are secured rigidly to said inner region of said bearing body, a lever device is secured rigidly to said outer region of said bearing body, said lever device is angularly offset from said carrier arm in the direction of lifting in relation to the direction of said carrier arm, each of said hydraulic units is arranged substantially horizontally in each of said floor groups, and one of said bearing halves of said hydraulic unit is provided on said lever device and the other of said bearing halves of said hydraulic unit is provided on said floor group.

9. Hydraulic hoist platform according to claim 8, wherein said inner tube has an end and said torsion sleeve has an outer end, a first cover closes said inner tube at its end, a second cover closes said torsion sleeve at its outer end, said covers have mutually facing surfaces formed as clutch halves, and a clamping device draws said covers against one another.

10. Hydraulic hoist platform according to claim 9, wherein said first cover has a threaded hole, said second cover has a through hole, said clamping device comprises a headed screw having a shank which is screwed into said threaded hole in said first cover and passes through said through hole in said second cover, and said head of said screw presses at least indirectly upon said second cover.

11. Hydraulic hoist platform according to claim 9, wherein said clutch halves are Hirth-type toothings.

12. Hydraulic hoist platform according to claim 9, wherein each of said floor group halves has an outer side member with an inner surface and a bearing ring, said second cover terminates away from the said inner surface of said outer side member, said second cover has an external cup-shaped depression, a disc is radially and immovable locked in said depression, and a rotational bearing surface is arranged on the circumference of said disc and guided in said bearing ring of said side member.

13. Hydraulic hoist platform according to claim 12, wherein said rotational bearing surface has a diameter that is equal to the external diameter of said inner tube, and a second similar bearing ring for said inner tube is provided on said inner side member.

14. Hydraulic hoist platform according to claim 13, wherein said bearing rings form axial movement stops for said torsion sleeve.

15. Hydraulic hoist platform according to claim 8, wherein said inner tube is a synchronising tube subject to torsion loading and extends between said floor group halves.

16. Hydraulic hoist platform according to claim 15, wherein a guard tube has at each of its ends a flange which is rigidly connected with respective floor group halves and said synchronizing tube lies in said guard tube.

* * * * *

UNITED STATES PATENT AND TRADEMARK OFFICE

CERTIFICATE OF CORRECTION

PATENT NO. : 4,798,266

DATED : January 17, 1989

INVENTOR(S) : Finkbeiner

It is certified that error appears in the above-identified patent and that said Letters Patent is hereby corrected as shown below:

The sheets of drawings consisting of Figures 2-8 should be added as per attached sheets.

On the title page "16 Claims, 1 Drawing Sheet" should read --
--16 Claims, 7 Drawing Sheets--.

Signed and Sealed this

Eleventh Day of July, 1989

*Attest:*

DONALD J. QUIGG

*Attesting Officer*

*Commissioner of Patents and Trademarks*